US007703770B2

(12) United States Patent
Ito

(10) Patent No.: US 7,703,770 B2
(45) Date of Patent: Apr. 27, 2010

(54) SHEET DISCHARGE DEVICE

(75) Inventor: Yoshiyuki Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 82 days.

(21) Appl. No.: 11/850,048

(22) Filed: Sep. 5, 2007

(65) Prior Publication Data

US 2008/0061500 A1 Mar. 13, 2008

(30) Foreign Application Priority Data

Sep. 8, 2006 (JP) ..... 2006-243682

(51) Int. Cl.
*B65H 29/54* (2006.01)

(52) U.S. Cl. ..... 271/307; 271/306

(58) Field of Classification Search ..... 271/314, 271/307, 272

See application file for complete search history.

(56) References Cited

U.S. PATENT DOCUMENTS

| | | | | |
|---|---|---|---|---|
| 6,089,567 | A * | 7/2000 | Yatsuhashi et al. | 271/314 |
| 6,755,412 | B1 * | 6/2004 | Glowner | 271/12 |
| 2006/0157922 | A1 * | 7/2006 | Carter et al. | 271/264 |

FOREIGN PATENT DOCUMENTS

| | | | | |
|---|---|---|---|---|
| JP | 08-245034 | A | | 9/1996 |
| JP | 8-319050 | A | | 12/1996 |
| JP | 11-079514 | A | | 3/1999 |
| JP | 11-208957 | A | | 8/1999 |
| JP | 2000-327198 | A | | 11/2000 |
| JP | 2001-206605 | A | | 7/2001 |
| JP | 2001206605 | A | * | 7/2001 |
| JP | 2006-193263 | A | | 7/2006 |

OTHER PUBLICATIONS

JP Office Action dtd Aug. 5, 2008, JP Appln. 2006-243682 (partial translation).

* cited by examiner

*Primary Examiner*—Patrick Mackey
*Assistant Examiner*—Ernesto Suarez
(74) *Attorney, Agent, or Firm*—Banner & Witcoff, Ltd.

(57) ABSTRACT

In an image forming apparatus, a sheet discharge device is provided. The sheet discharge device may include a drive roller and a driven roller driven by the drive roller. Also, the sheet discharge device can have a flange portion disposed at one end of the driven roller in a longitudinal direction thereof so as to rotate together with the driven roller. The flange portion may include a cutout having a first guide surface and a second guide surface disposed downstream of the first guide surface in a rotating direction of the driven roller. The first guide surface may be longer than the second guide surface.

12 Claims, 11 Drawing Sheets

SHEET DISCHARGE DEVICE

CROSS REFERENCE TO RELATED APPLICATION

The present application claims priority to and the benefit of Japanese Patent Application No. 2006-243682, which was filed on Sep. 8, 2006, the disclosure of which is incorporated herein by reference in its entirety.

BACKGROUND

1. Field

Aspects of the invention relate to sheet discharge devices, for use in image forming apparatuses, configured to discharge a sheet from the image forming apparatuses.

2. Description of Related Art

Known image forming apparatuses, such as facsimile machines, copiers, and laser printers, discharge sheets after an image is formed on the sheets.

A known image forming apparatus includes a drive roller and a driven roller that is driven by the drive roller, to discharge a sheet on a discharge tray. A flange having circular shaped cutouts on its periphery is disposed on one or both ends of the driven roller in its axial direction, to push the sheet toward the discharge tray to prevent the sheet from adhering to the drive roller or driven roller due to static charge on the sheet.

SUMMARY

An aspect of the invention is to provide a sheet discharge device configured to smoothly discharge a sheet.

BRIEF DESCRIPTION OF THE DRAWINGS

Illustrative aspects of the invention will be described in detail with reference to the following figures wherein.

DETAILED DESCRIPTION

Illustrative aspects of the invention will be described in detail with reference to the accompanying drawings.

Figure 1:
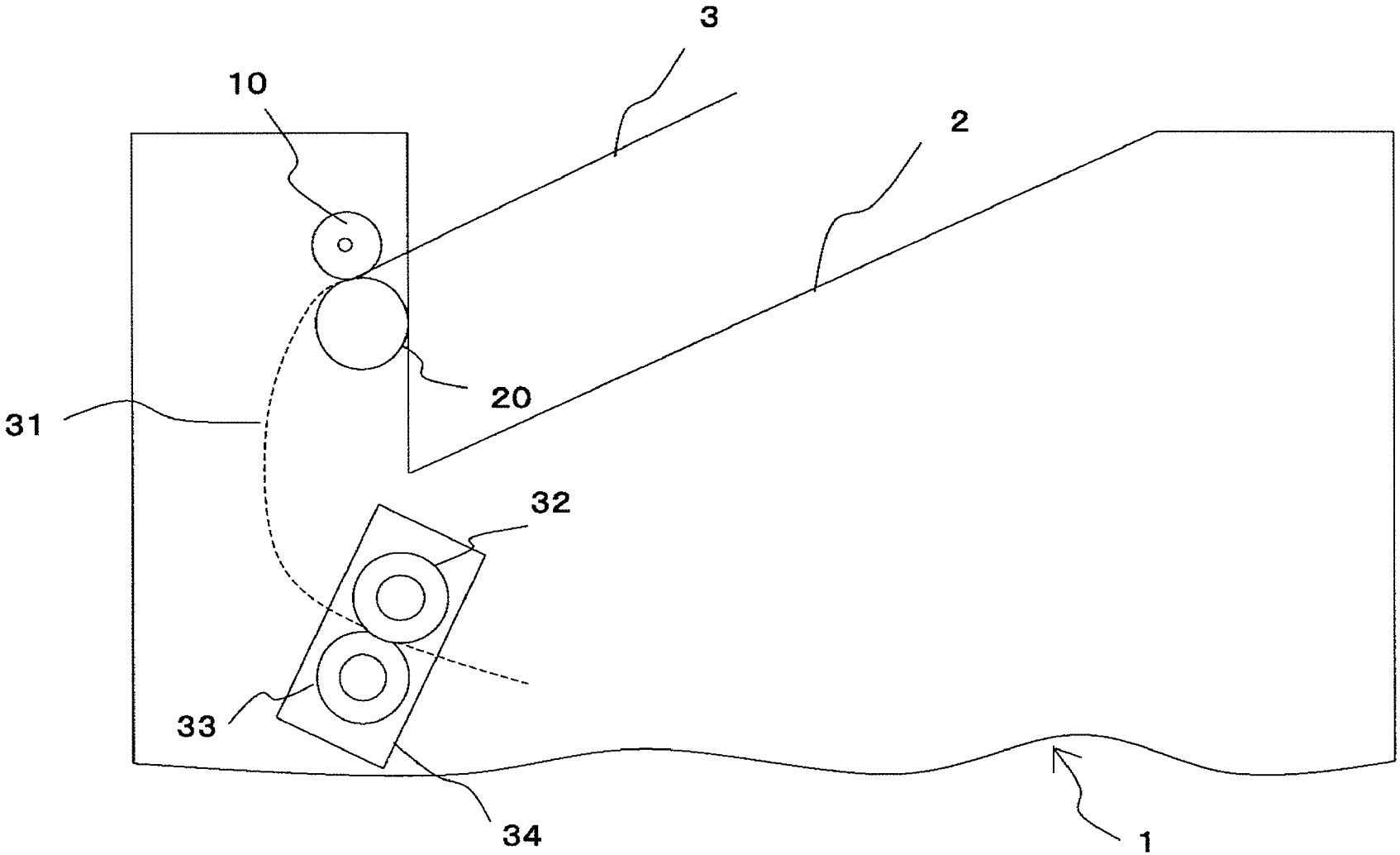
FIG. 1 is a side view of a sheet discharge device according to an illustrative aspect of the invention.

FIG. 1 is a schematic showing a sheet discharge device 1 provided in an image forming apparatus, for example a laser printer. The sheet discharge device 1 may include a fixing unit 34 including a heat roller 32 and a pressure roller 33, a drive roller 10, and a discharge roller 20 including a roller 28 and a flange portion 21 (in FIG. 3) that may be integrally formed with a resin material, such as POM (polyacetal). The fixing unit 34, the drive roller 10 and the discharge roller 20 are disposed on a sheet conveying path 31. The drive roller 10 and the discharge roller 20 are disposed downstream of the fixing unit 34 in a conveying direction of a sheet 3. A developer image on the sheet 3 is thermally fixed thereon by the fixing unit 34. Thereafter, the sheet 3 is discharged by the drive roller 10 and the discharge roller 20 onto a discharge tray 2, which is formed on an upper face of an image forming apparatus, such as a laser printer.

Figure 2:
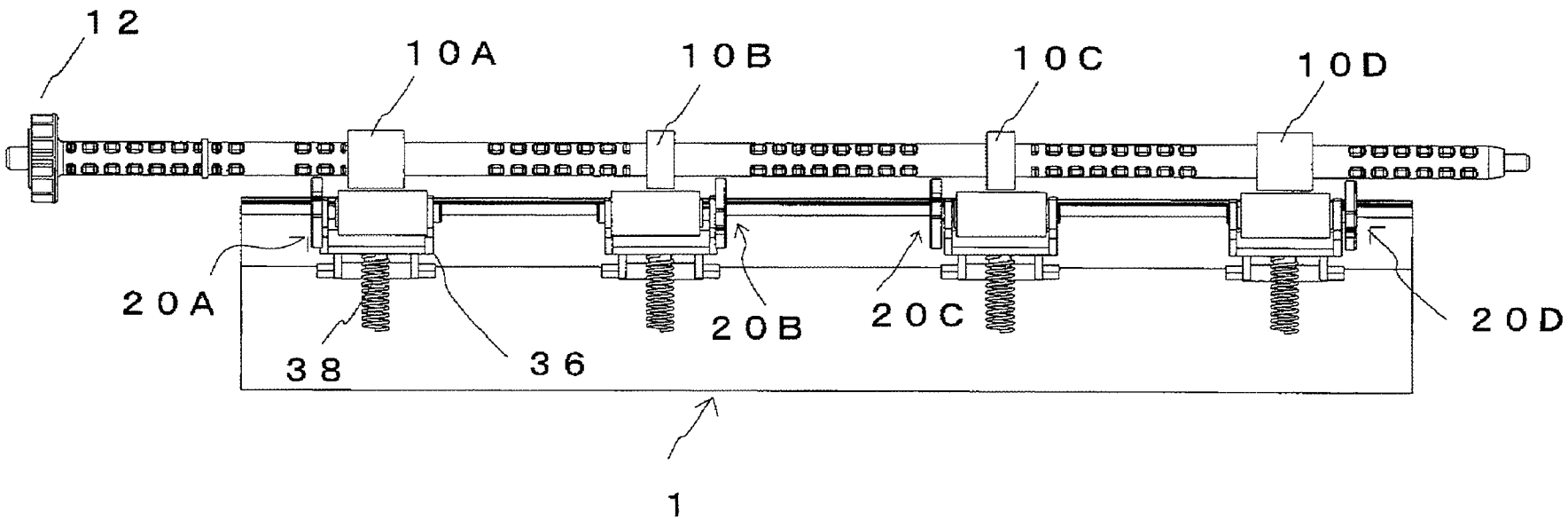
FIG. 2 is a front view of a portion of the sheet discharge device.

As shown in FIG. 2, the drive roller 10 may include two pairs of drive rollers 10A, 10B and 10C, 10D that are mounted on a drive shaft 12. In correspondence with the drive rollers 10A, 10B, and 10C, 10D, the discharge roller 20 may include two pairs of discharge rollers 20A, 20B, and 20C, 20D. The discharge rollers 20A, 20B, 20C, 20D are driven by the corresponding drive rollers 10A, 10B, 10C, 10D and rotate while contacting the corresponding drive rollers 10A, 10B, 10C, 10D. The length/width of the drive roller 10 in its axial direction may be shorter than the length of the discharge roller 20 in its axial direction. The width of the drive roller 10 in the axial direction or distance from an end of the drive roller 10 in its axial direction to the flange portion 21 may be changed to alter the curve or angle of the corrugation of the sheet 3. Each discharge roller 20 may be rotatably supported by a holder 36. A spring 38 may be disposed between the sheet discharge device 1 and the holder 36 to urge the holder 36 upward. By the urging force of the spring 38, the discharge roller 20 may be pressed against the drive roller 10. The flange portion 21 may be disposed on an end of each pair of the discharge rollers 20A, 20B, and 20C, 20D, such that the other ends of each pair of discharge rollers 20A, 20B, and 20C, 20D face each other. More specifically with reference to FIG. 2, the flange portion 21 is disposed on the left end of the discharge rollers 20A, 20C and on the right end of the discharge rollers 20B, 20D.

Figure 3:
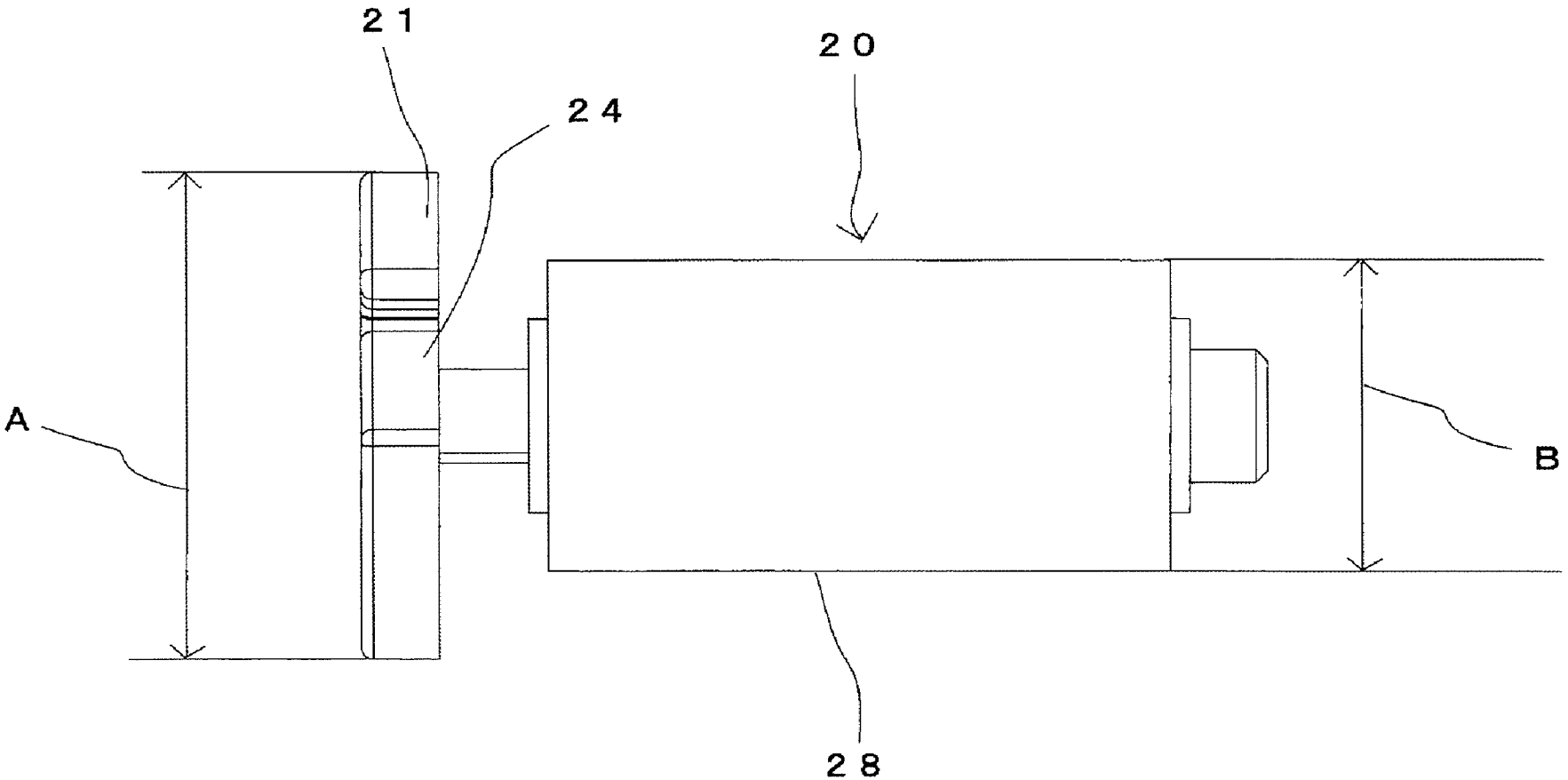
FIG. 3 is a side view of a discharge roller.

As shown in FIG. 3, a shaft may extend from each end of the roller 28 in its axial direction to be mounted on the holder 36.

Figure 4:
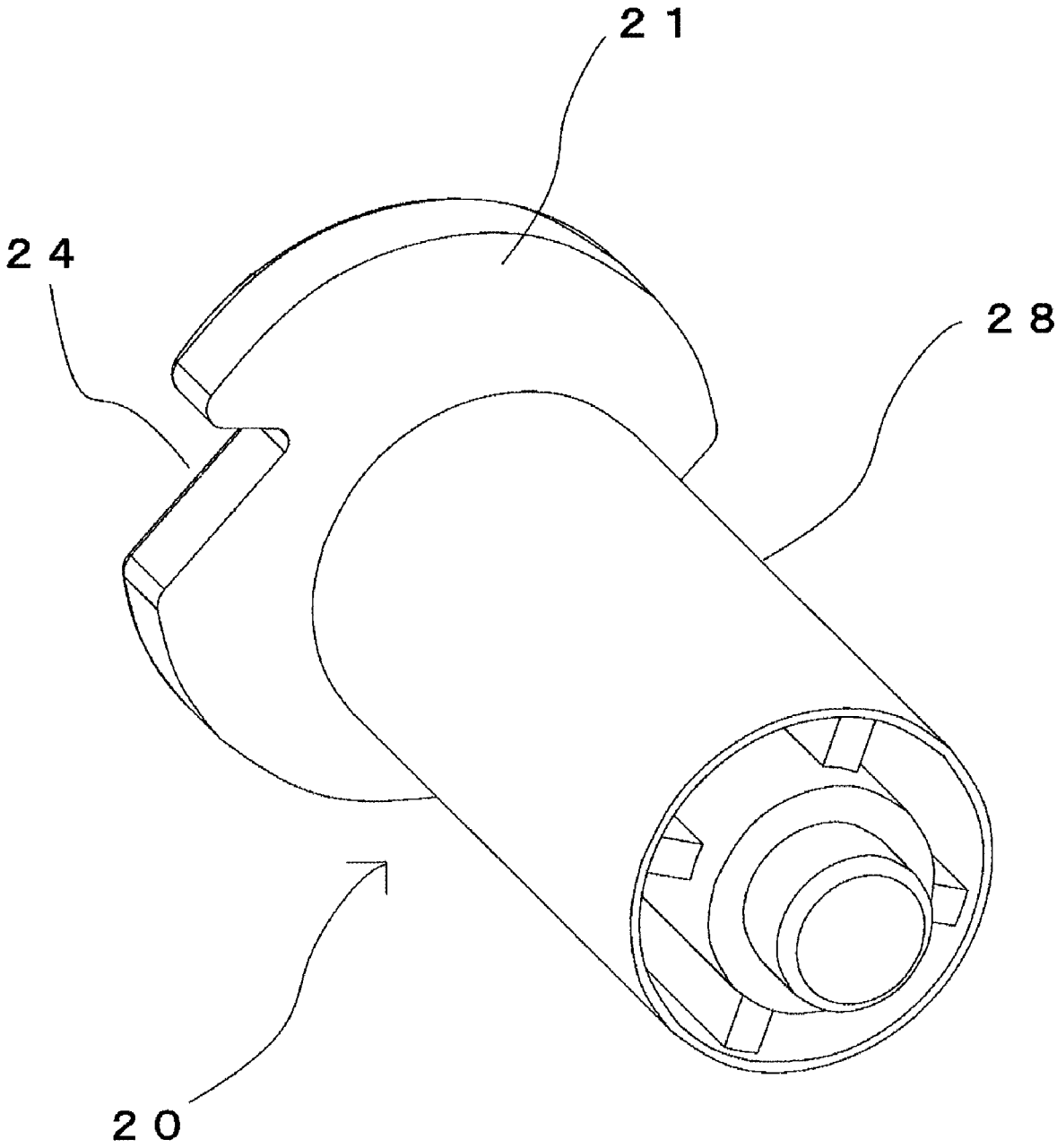
FIG. 4 is a perspective view of the discharge roller.

As shown in FIGS. 3 to 5, the flange portion 21 may include cutouts 24. As shown in FIG. 3, a diameter A of a portion of the flange portion 21 that does not intersect the cutouts 24 may be greater than a diameter B of the roller 28. With the flange portions 21, the sheet 3 may be corrugated in a direction perpendicular to the sheet conveying direction while being held between the drive rollers 10 and the discharge rollers 20, to increase the rigidity or stiffness of the sheet 3. Thus, the sheet 3 may be discharged onto the discharge tray 2 without getting caught on the discharge tray 2.

Figure 5A:
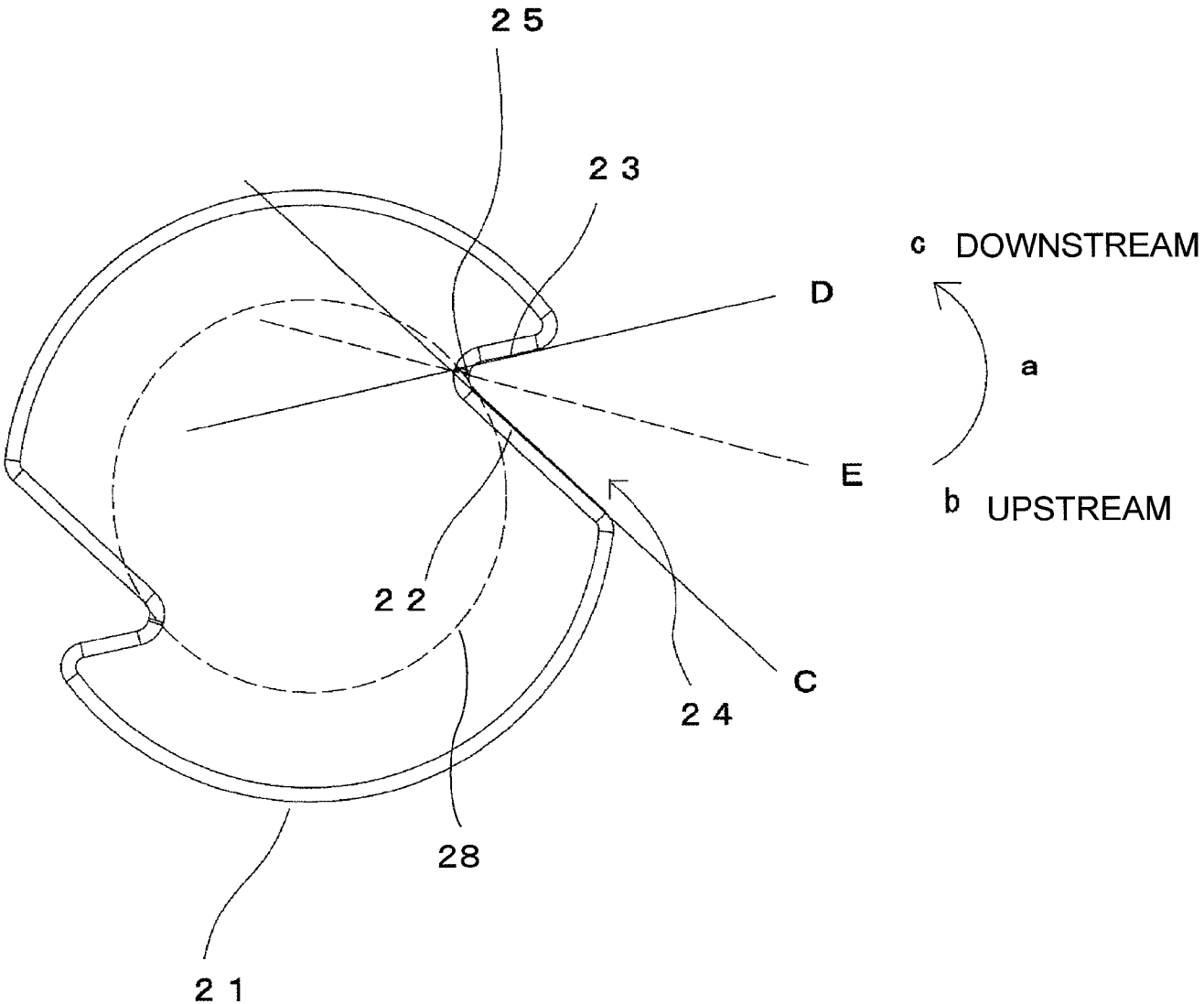
FIGS. 5A and 5B are front views of a flange of the discharge roller.

As shown in FIG. 5A, the flange portion 21 is configured to rotate in the direction indicated by the arrow "a" (letters "b" and "c" represent upstream and downstream sides, respectively, in the rotating direction of the flange portion 21). Each cutout 24 may include a first guide surface 22, a second guide surface 23 which may be shorter than the first guide surface 22, and a curve portion 25 disposed between the first and second guide surfaces 22, 23. The first guide surface 22 may be disposed in the upstream side of the second guide surface 23. The first guide surface 22 may function as a guide surface to guide the sheet 3 when it is fed toward a nip portion between the drive roller 10 and the discharge roller 20, as well as a pushing surface to push the sheet 3 when it is discharged to the discharge tray 2.

Figure 5B:
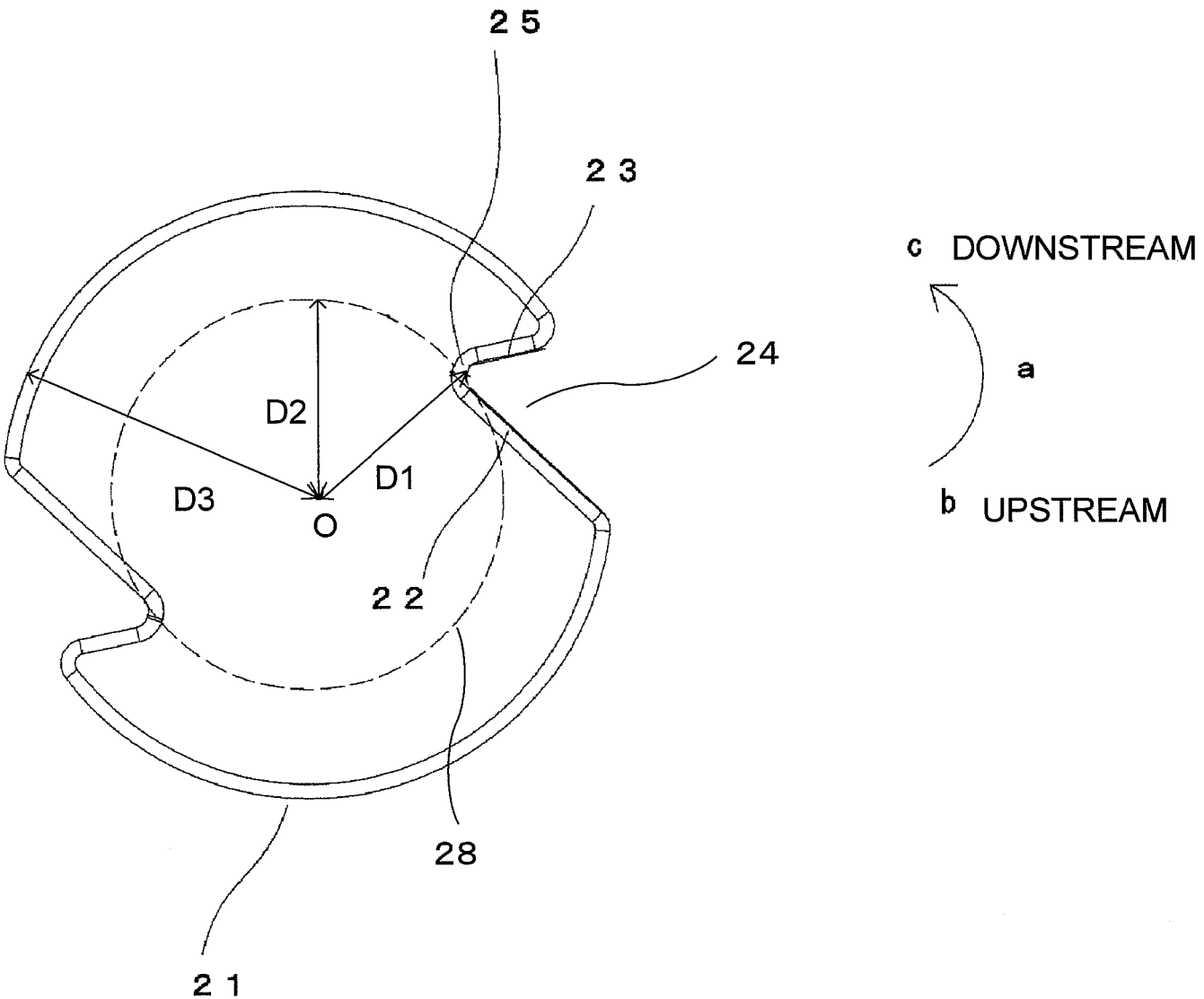

The first guide surface 22 may extend from a rim of the flange portion 21 to the curve portion 25. As shown in FIG. 5B, distance D1 from a center O of the roller 28 to the curve portion 25 may be equal to distance D2 from the center O to the outer circumferential surface of the roller 28. An angle defined by a line C extending from the first guide surface 22 and a line D extending from the second guide surface 23 may be less than 90 degrees, and more specifically between 60 and 90 degrees. With respect to a line E that divides the angle between the lines C and D into two equal angles, the first and second guide surfaces 22, 23 may be asymmetrical. The ratio between the lengths of the first and second guide surfaces 22, 23 may be approximately 3:1. The first guide surface 22 may be flat.

Figure 6:
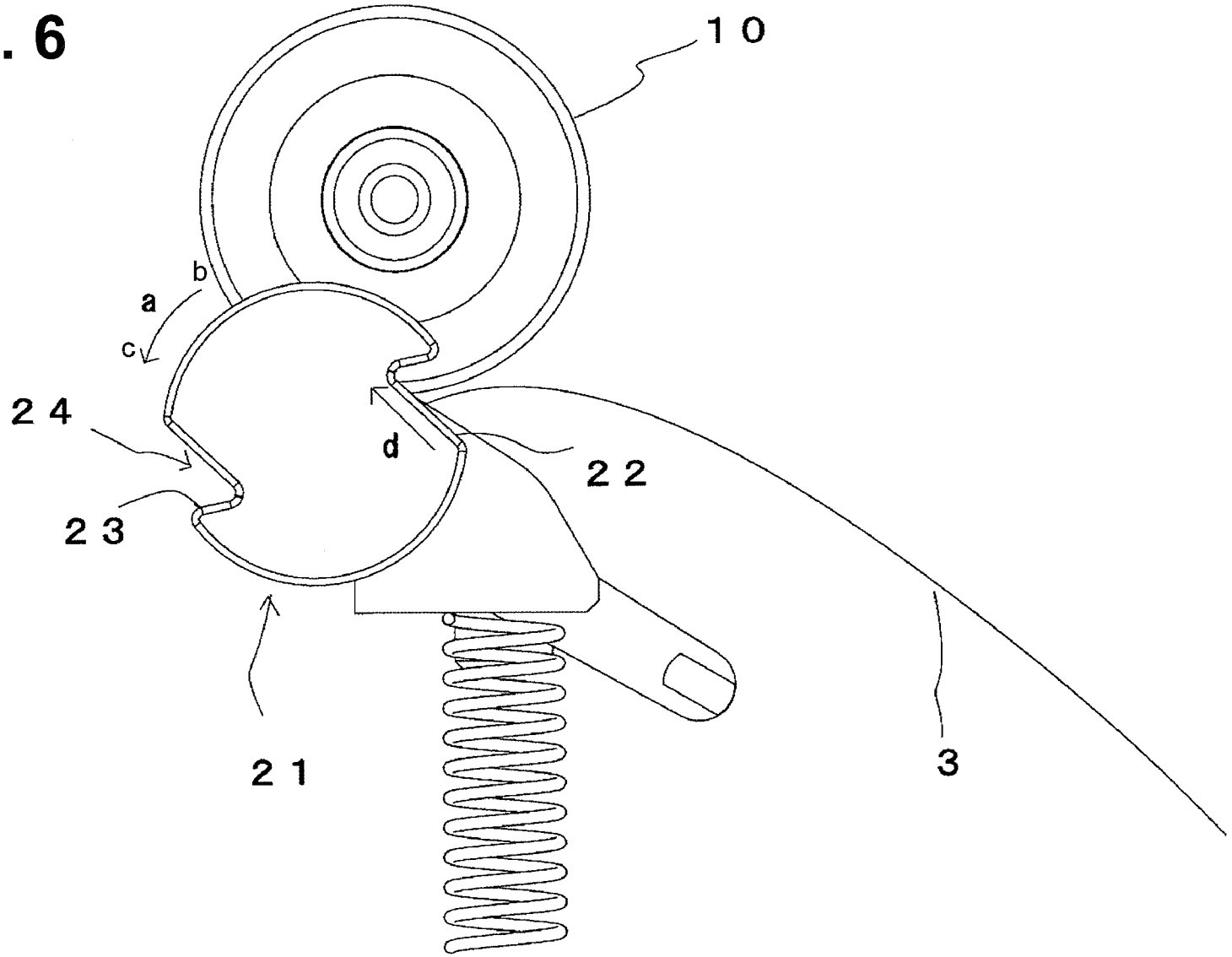
FIG. 6 is a side view of the sheet discharge device showing a sheet being fed in the sheet discharge device.

As shown in FIG. 6, when the sheet 3, whose leading end may face downward after the image is thermally fixed on the sheet 3 by the fixing unit 34, is fed to the discharge roller 20, the leading end may contact the first guide surface 22 and be guided in the direction "d" in accordance with the rotation of the discharge roller 20. The curved sheet 3 may be smoothly guided along the first guide surface 22 toward the nip portion between the drive roller 10 and the discharge roller 20. Because the first guide surface 22 may guide the leading end of the sheet 3 in the rotating direction of the roller 28, the curved sheet 3 may not apply load toward the axis of the roller 28. By guiding the leading end of the sheet 3 in the rotating direction of the flange portion 21 and reducing a load applied toward the axis of the roller 28, the possibility of a sheet jam may be reduced.

Figure 7:
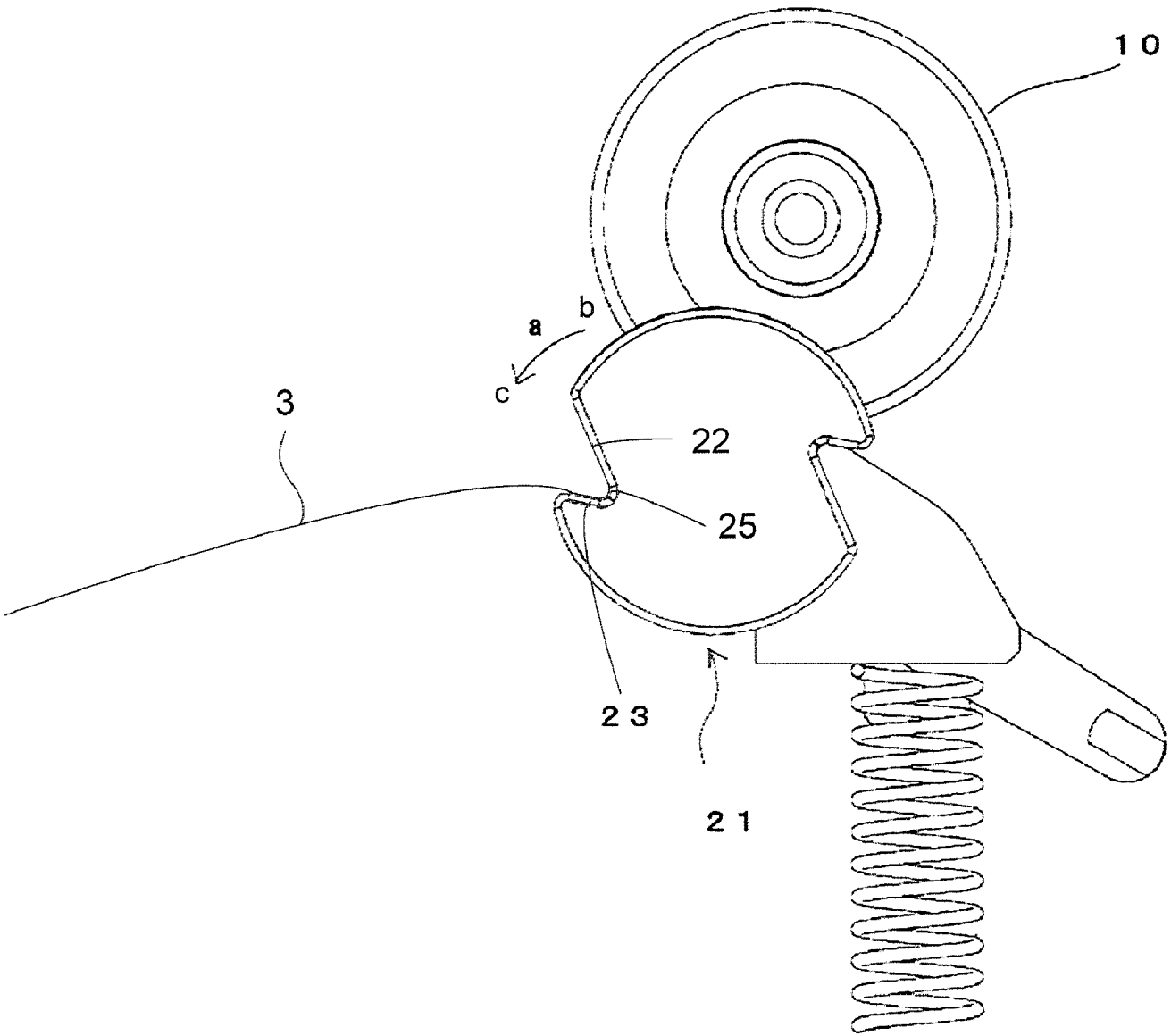
FIGS. 7 and 8 are side views of the sheet discharge device showing the sheet being discharged out of the sheet discharge device.
Figure 8:
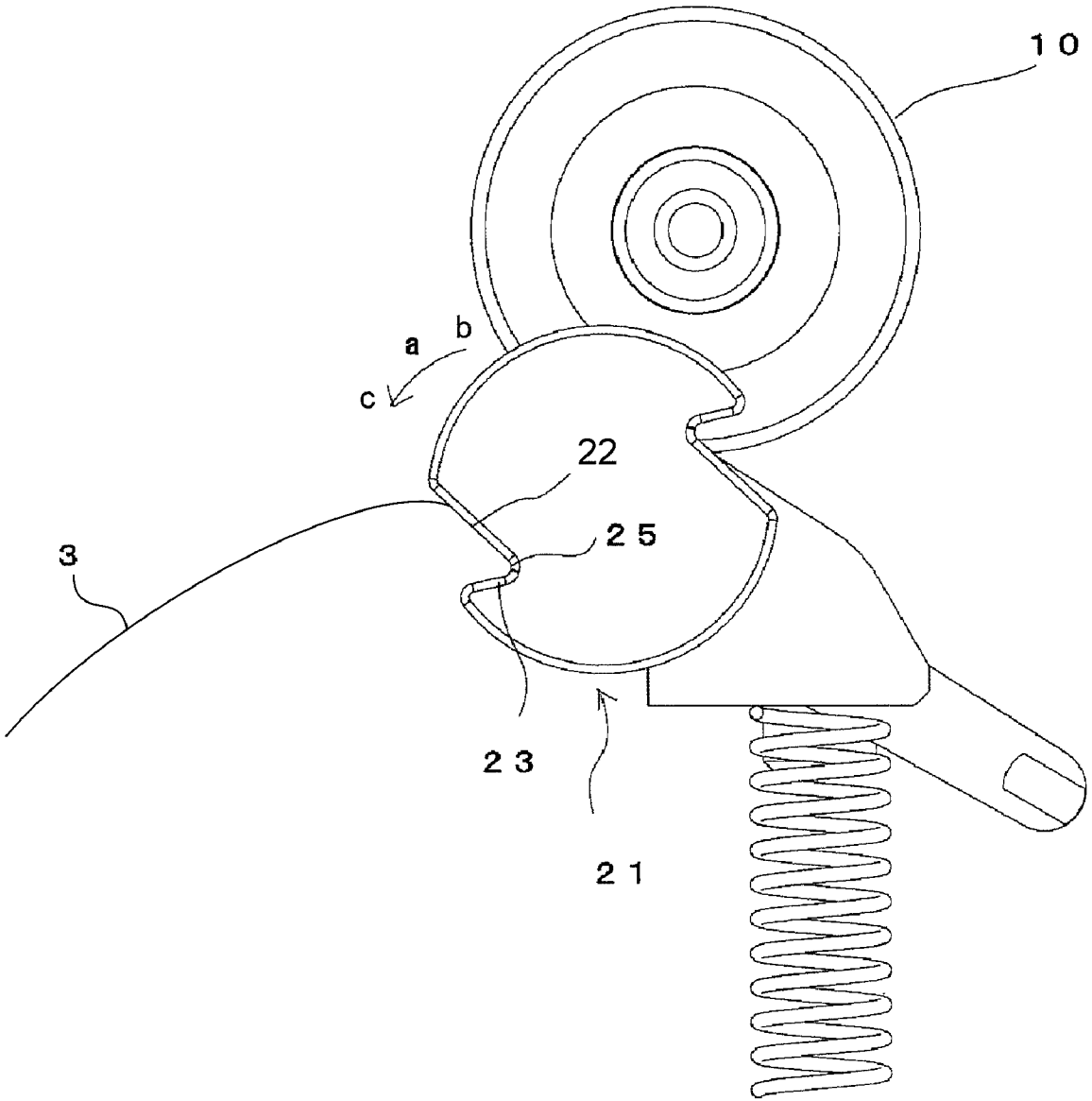

As shown in FIG. 7, when the trailing end of the sheet 3 passes through the nip portion between the discharge roller 20 and the drive roller 10, the sheet 3 may be received by the second guide surface 23. As the flange portion 21 rotates in the direction "a" together with the roller 28, the trailing end of the sheet 3 may be pushed by the first guide surface 22, as shown in FIG. 8. The curve portion 25 may smoothly guide the trailing end of the sheet 3 from the second guide surface 23 to the first guide surface 22. With such a structure, the sheet 3 may be more readily discharged to the discharge tray 2 even when static is built up on the sheet 3 due to friction applied, for example, during sheet conveyance by various rollers. Accordingly, the succeeding sheets 3, if any, may be smoothly guided to the sheet discharge device 1.

With the cutouts 24, the sheet 3 may be smoothly guided to the nip portion between the drive roller 10 and the discharge roller 20 and smoothly discharged to the discharge tray 2.

The curve portion 25 may be curved or rounded between the first and second guide surfaces 22, 23. Therefore, the likelihood of the leading or trailing end of the sheet 3 getting caught in the curved portion 25 may be reduced, as compared with a case where the first and second guide surfaces 22, 23 connect with each other without having a curve or rounded portion. Thus, the sheet 3 may smoothly be guided and discharged.

Angles defined between the first and second guide surfaces 22, 23 may be less than 90 degrees. Therefore, the trailing end of the sheet 3 may be received at the second guide surface 23 and pushed by the first guide surface 22. Thus, the sheet 3 may be smoothly discharged. Further, the flange portion 21 may have a nearly circular shape. Thus, the sheet 3 may be favorably corrugated in the direction perpendicular to the sheet conveying direction to increase the rigidity of the sheet 3 and to reduce the curve in the sheet 3. Thus, the sheet 3 may be discharged onto the discharge tray 2 favorably.

According to an illustrative aspect of the invention, the flange portion 21 has two cutouts 24. However, the flange portion 21 may have only one cutout 24 in other illustrative aspects. Further, the flange portion 21 may have more than two cutouts 24 in still other illustrative aspects.

A shaft may extend from each end of the roller 28 in its axial direction to allow for mounting onto the holder 36, so that the roller 28 and the flange portion 21 may be separated from each other via the shaft. However, the flange portion 21 may be disposed on the roller 28 without a shaft therebetween.

The outer circumferential surface of the roller 28 may be positioned corresponding to the curve portion 25. With such a structure, the sheet 3 may readily contact the first guide surface 22, the second guide surface 23, and/or the curve portion 25 when being fed to and discharged from the sheet discharge device 1. Thus, both sheet feeding and sheet discharging from the sheet discharge device 1 may be smoothly performed.

According to an aspect of the invention, distance D1 from the center O of the roller 28 to the curve portion 25 is equal to distance D2 from the center O to the outer circumferential surface of the roller 28, as shown in FIG. 5B. However, if the distance D2 is smaller than distance D3 from the center O to an outer circumferential surface of the flange portion 21, the curve portion 25 may be disposed at other positions because the first guide surface 22, which functions as a guide surface and pushing surface when the sheet 3 is fed or discharged, is disposed outside the outer circumferential surface of the roller 28.

Figure 9:
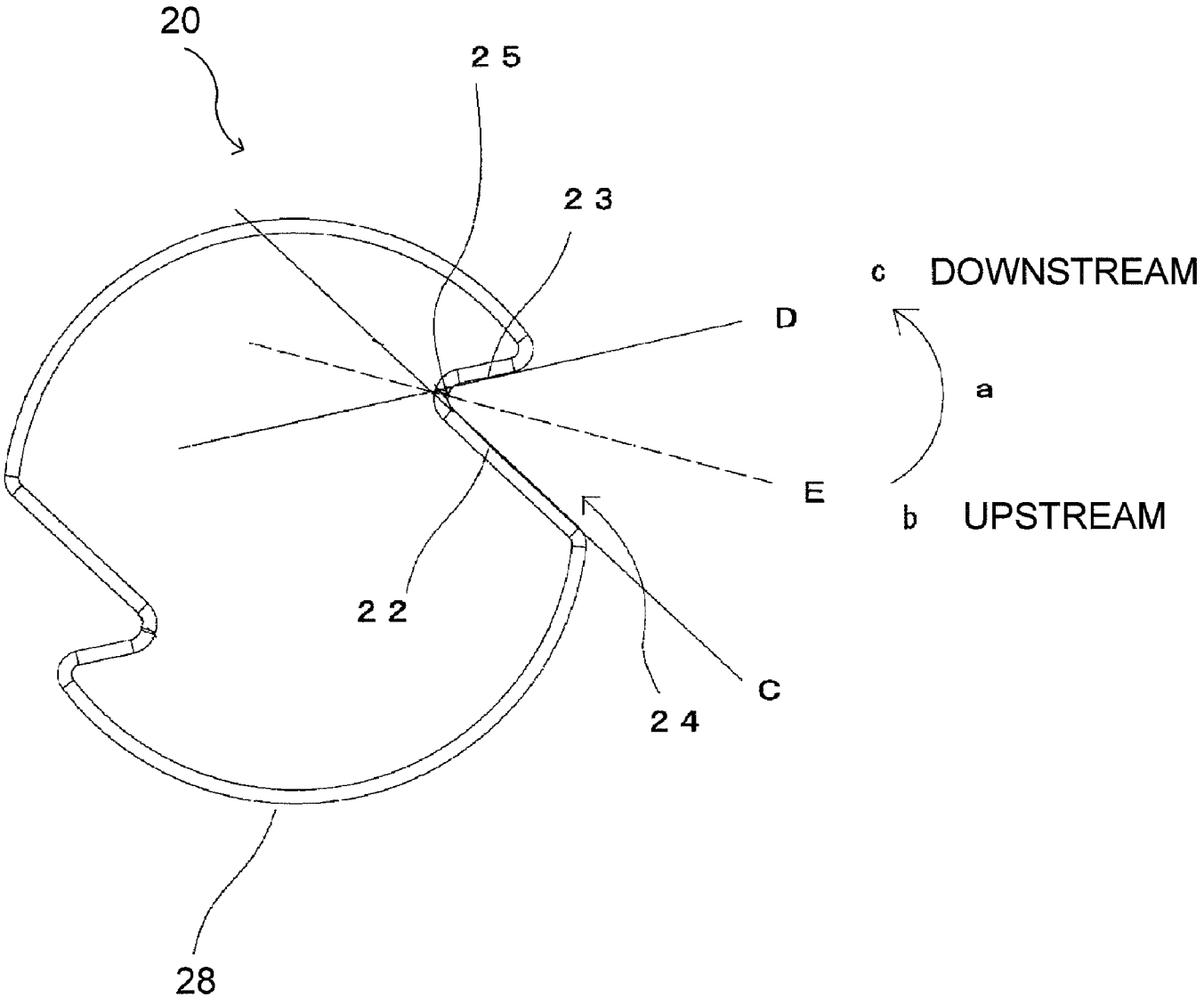
FIG. 9 is a front view of a discharge roller of a sheet discharge device according to another aspect of the invention.
Figure 10:
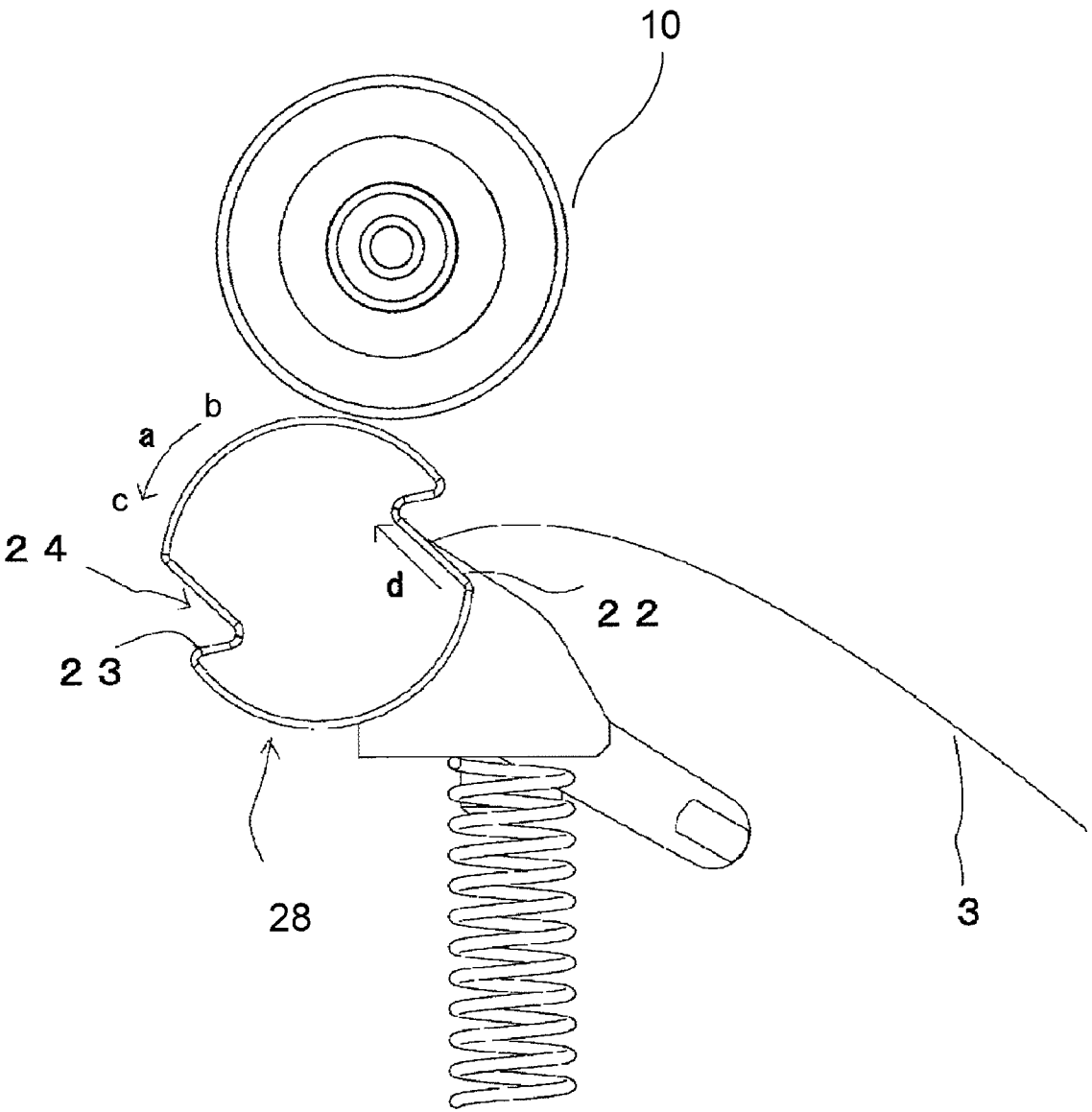
FIG. 10 is a side view of the sheet discharge device according to another aspect of the invention, showing a sheet being fed in the sheet discharge device.

According to an illustrative aspect of the invention, the discharge roller 20 includes the roller 28. As shown in FIGS. 9 and 10, the roller 28 may have a cutout 24 including the first guide surface 22, the second guide surface 23 shorter than the first guide surface 22, and the curve portion 25 disposed between the first and second guide surfaces 22, 23. The second guide surface 23 is disposed downstream of the first guide surface 22 in the rotating direction of the roller 28. That is, the second guide surface 23 is disposed downstream from the first guide surface 22 in the rotating direction of the roller 28.

While aspects of the invention have been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the embodiments disclosed herein. It is intended that the specification and the described examples are illustrative with the true scope of the invention being defined by the following claims.

What is claimed is:

1. A sheet discharge device, comprising:

a drive roller;

a driven roller driven by the drive roller, and a flange portion disposed at one end of the driven roller in a longitudinal direction thereof so as to rotate together with the driven roller, wherein the flange portion includes a cutout having a first guide surface configured to guide a leading end of a sheet toward a nip portion between the drive roller and the driven roller and a second guide surface disposed downstream of the first guide surface in a rotating direction of the driven roller, the first guide surface being longer than the second guide surface and the entire length of the first guide surface being flat.

2. The sheet discharge device according to claim 1, wherein the first guide surface is approximately three times longer than the second guide surface.

3. A sheet discharge device, comprising:

a drive roller;

a driven roller driven by the drive roller, and a flange portion disposed at one end of the driven roller in a longitudinal direction thereof so as to rotate together with the driven roller, wherein the flange portion includes a cutout having a first guide surface and a second guide surface disposed downstream of the first guide surface in a rotating direction of the driven roller, the first guide surface being longer than the second guide surface, and wherein the cutout further includes a curved portion for joining the first guide surface and the second guide surface, and the distance from a center of the driven roller to the curved portion is equal to the distance from the center to an outer circumferential surface of the driven roller.

4. The sheet discharge device according to claim 1, wherein a diameter of a portion of the flange portion that does not intersect the cutout is greater than a diameter of the driven roller.

5. The sheet discharge device according to claim 1, a length of the drive roller in an axial direction thereof is shorter than a length of the driven roller in an axial direction thereof.

6. The sheet discharge device according to claim 1, wherein the flange portion and an end of the drive roller in an axial direction thereof are spaced apart from each other.

7. The sheet discharge device according to claim 1, wherein an angle defined between the first guide surface and the second guide surface is less than 90 degrees.

8. The sheet discharge device according to claim 7, wherein the angle is between 60 and 90 degrees.

9. The sheet discharge device according to claim 1, wherein the second guide surface is configured to receive a trailing end of a sheet that has passed through the nip portion between the drive roller and the driven roller.

10. The sheet discharge device according to claim 9, wherein the first guide surface is further configured to push the trailing end of the sheet received by the second guide surface toward a discharge tray.

11. The sheet discharge device according to claim 10, wherein the cutout further includes a curved portion for joining the first guide surface and the second guide surface, the curved portion configured to guide a sheet from the second guide surface to the first guide surface.

12. The sheet discharge device according to claim 1, wherein the flange portion includes two cutouts.

* * * * *